US009331420B2

(12) United States Patent
Bedell et al.

(10) Patent No.: US 9,331,420 B2
(45) Date of Patent: May 3, 2016

(54) COMPRESSOR HAVING TERMINAL PLUG ASSEMBLY

(75) Inventors: Rick T. Bedell, Huber Heights, OH (US); Gregg M. Hemmelgarn, Saint Henry, OH (US); Matthew J. Heidecker, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 1171 days.

(21) Appl. No.: 12/684,386

(22) Filed: Jan. 8, 2010

(65) Prior Publication Data

US 2010/0196175 A1 Aug. 5, 2010

Related U.S. Application Data

(60) Provisional application No. 61/143,607, filed on Jan. 9, 2009.

(51) Int. Cl.

| | |
|---|---|
| ***F04B 17/00*** | (2006.01) |
| ***H01R 13/52*** | (2006.01) |
| ***F04B 39/12*** | (2006.01) |

(Continued)

(52) U.S. Cl.

CPC ..... *H01R 13/52* (2013.01); *F04B 39/12* (2013.01); *F04B 39/121* (2013.01); *F04B 39/14* (2013.01); *F04C 23/008* (2013.01); *F04C 18/0215* (2013.01); *F04C 2240/30* (2013.01);

(Continued)

(58) Field of Classification Search

CPC ..... F04B 39/12; F04B 39/121; F04B 39/14; H01R 13/52; H01R 13/533; H01R 13/5219; F04C 23/008; F04C 18/0215; F04C 2240/30; F04C 2240/803

USPC ..... 417/410.5; 310/71, 88, 89; 439/370, 439/373, 559, 685

See application file for complete search history.

(56) References Cited

U.S. PATENT DOCUMENTS 1,635,507 A * 7/1927 Seasock ..... 200/51.14
3,160,460 A * 12/1964 Wyzenbeek ..... 439/685

(Continued)

FOREIGN PATENT DOCUMENTS

CN 1611781 A 5/2005
CN 101184919 A 5/2008

(Continued)

OTHER PUBLICATIONS

Machine Translation of Japanese Patent JP 2008169754.*

(Continued)

*Primary Examiner* — Peter J Bertheaud
*Assistant Examiner* — Dnyanesh Kasture
(74) *Attorney, Agent, or Firm* — Harness, Dickey & Pierce, P.L.C.

(57) ABSTRACT

A compressor may include a shell, a compression mechanism supported within the shell, a motor drivingly engaged with the compression mechanism, and a terminal assembly. The terminal assembly may include a cover secured relative to the shell, a terminal block fixed to the shell and in electrical communication with the motor, and a plug. The plug may be engaged with the terminal block and may provide electrical communication between the terminal block and a wire. The plug may include a first side facing the terminal block and a second side facing a wall of the cover. The second side may include a protrusion extending toward the wall and spaced a distance therefrom.

21 Claims, 5 Drawing Sheets

(51) Int. Cl.

| | |
|---|---|
| ***F04B 39/14*** | (2006.01) |
| ***F04C 23/00*** | (2006.01) |
| *F04C 18/02* | (2006.01) |
| *H01R 13/533* | (2006.01) |

(52) U.S. Cl.
CPC ..... *F04C2240/803* (2013.01); *H01R 13/5219* (2013.01); *H01R 13/533* (2013.01)

(56) References Cited

U.S. PATENT DOCUMENTS

| | | | | | |
|---|---|---|---|---|---|
| 4,512,724 | A | | 4/1985 | Horvath | |
| 4,699,592 | A | * | 10/1987 | Gallo et al. | 439/27 |
| 4,998,035 | A | * | 3/1991 | Jensen | 310/91 |
| 5,139,431 | A | * | 8/1992 | Saitoh et al. | 439/364 |
| 5,199,898 | A | | 4/1993 | Wisner | |
| 5,249,899 | A | * | 10/1993 | Wilson | 411/82 |
| 5,336,105 | A | * | 8/1994 | Wisner | 439/367 |
| 5,801,465 | A | * | 9/1998 | Yamada | 310/71 |
| 6,155,805 | A | | 12/2000 | Fry | |
| 6,779,989 | B2 | * | 8/2004 | Makino et al. | 417/410.1 |
| 2002/0131869 | A1 | | 9/2002 | Makino et al. | |
| 2003/0143892 | A1 | | 7/2003 | Raypole et al. | |
| 2004/0118146 | A1 | | 6/2004 | Haller et al. | |
| 2005/0054234 | A1 | | 3/2005 | Daniel et al. | |
| 2006/0147314 | A1 | * | 7/2006 | Haller et al. | 417/63 |

FOREIGN PATENT DOCUMENTS

| | | | | |
|---|---|---|---|---|
| JP | 6017781 | A | | 1/1994 |
| JP | 2008169754 | A | * | 7/2008 |
| WO | WO-2006041147 | A1 | | 4/2006 |

OTHER PUBLICATIONS

International Search Report regarding International Application No. PCT/US2010/020478, dated Aug. 23, 2010.

Written Opinion of the International Searching Authority regarding International Application No. PCT/US2010/020478, dated Aug. 23, 2010.

Extended European Search Report regarding Application No. 10729558.6-2315/2307731, dated Feb. 28, 2012.

Chinese Office Action mailed Aug. 27, 2013 regarding Chinese Application No. 201080004242.8. Translation provided by Unitalen Attorneys at Law.

Second Chinese Office Action mailed Apr. 28, 2014 regarding Chinese Application No. 2010800042428 Translation provided by Unitalen Attorneys At Law.

* cited by examiner

COMPRESSOR HAVING TERMINAL PLUG ASSEMBLY

CROSS-REFERENCE TO RELATED APPLICATION

This application claims the benefit of U.S. Provisional Application No. 61/143,607, filed on Jan. 9, 2009. The entire disclosure of the above application is incorporated herein by reference.

FIELD

The present disclosure relates to compressors, and more specifically to compressor terminal assemblies.

BACKGROUND

This section provides background information related to the present disclosure which is not necessarily prior art.

Compressors may include terminal assemblies to provide electrical communication between a power source and a compressor motor. The terminal assemblies may include a plug engaged with a terminal block that is fixed to the compressor and enclosed by a cover. In various typical mounting arrangements, vibration may be transmitted between the cover and the plug.

SUMMARY

This section provides a general summary of the disclosure, and is not a comprehensive disclosure of its full scope or all of its features.

A compressor may include a shell, a compression mechanism supported within the shell, a motor drivingly engaged with the compression mechanism, and a terminal assembly. The terminal assembly may include a cover secured relative to the shell, a terminal block fixed to the shell and in electrical communication with the motor, and a plug. The plug may be engaged with the terminal block and may provide electrical communication between the terminal block and a wire. The plug may include a first side facing the terminal block and a second side facing a wall of the cover. The second side may include a protrusion extending toward the wall and spaced a distance therefrom.

The protrusion may be spaced the distance from the wall when the plug is fully engaged with pins of the terminal block. The spacing may provide at least fifty percent engagement between the pins and the plug when the plug is displaced from full engagement with the pins to a position where the protrusion abuts the wall.

The compressor may additionally include a seal surrounding the terminal block and located between the plug and the shell. The plug may bias the seal against the shell. The plug may compress the seal a distance greater than the distance between the protrusion and the wall. The cover may be engaged with the seal and may bias the seal against the shell at a location surrounding the plug.

The terminal assembly may additionally include a resilient member engaged with the protrusion and the wall of the cover to maintain engagement between the plug and the terminal block while limiting vibration transmission therebetween. The protrusion may define a cavity facing the cover and housing the resilient member therein. The resilient member may include a plug formed from an elastomer and abutting the protrusion and the wall of the cover. Alternatively, a resilient member may include a piston and a biasing member located within the cavity and urging the piston against the wall of the cover.

The compressor may additionally include a mounting bracket fixed to the shell and having a cover fixed thereto.

In another arrangement, a compressor may include a shell, a compression mechanism supported within the shell, a motor drivingly engaged with the compression mechanism, and a terminal assembly. The terminal assembly may include a cover secured relative to the shell, a terminal block fixed to the shell and in electrical communication with the motor, and a plug. The plug may be engaged with the terminal block and may provide electrical communication between the terminal block and a wire. The plug may include a first side facing the terminal block and a second side facing a wall of the cover. The second side may include a protrusion extending toward the wall and spaced a distance therefrom. The plug may be displaceable from a first position where the plug is fully engaged with pins of the terminal block and free from engagement with the cover and a second position where the protrusion abuts the wall of the cover and the plug maintains at least fifty percent engagement with the pins.

The compressor may further include a seal surrounding the terminal block and located between the plug and the shell. The plug may bias the seal against the shell. The plug may be spaced a distance from the wall of the cover when fully engaged with the pins. The plug may compress the seal a distance greater than the distance between a protrusion and the wall. The cover may be engaged with the seal and may bias the seal against the shell at a location surrounding the plug.

A terminal assembly for a compressor having a motor contained within a shell and a terminal block fixed to the shell and in electrical communication with the motor may include a cover and a plug. The cover may be adapted to be secured relative to the shell and the plug may be engaged with the terminal block. The plug may provide electrical communication between the terminal block and a wire. The plug may include a first side facing the terminal block and a second side facing a wall of the cover. The second side may include a protrusion adapted to extend toward the wall and be spaced a distance therefrom.

The protrusion may be adapted to be spaced the distance from the wall when the plug is fully engaged with pins of the terminal block. The spacing may provide at least fifty percent engagement between the pins and the plug when the plug is displaced from full engagement with the pins to a position where the protrusion abuts the wall.

The terminal assembly may further include a resilient member engaged with the protrusion in the wall of the cover to maintain engagement between the plug and a terminal block while limiting vibration transmission therebetween. The protrusion may define a cavity facing the cover housing the resilient member therein. The resilient member may include a plug formed from an elastomer and abutting the protrusion and the wall of the cover. The resilient member may alternatively include a piston and a biasing member located within the cavity and urging the piston against the wall of the cover.

The terminal assembly may further include a seal surrounding the terminal block and located between the plug and the shell. The plug may bias the seal against the shell and compress the seal a distance greater than the distance between the protrusion and the wall.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
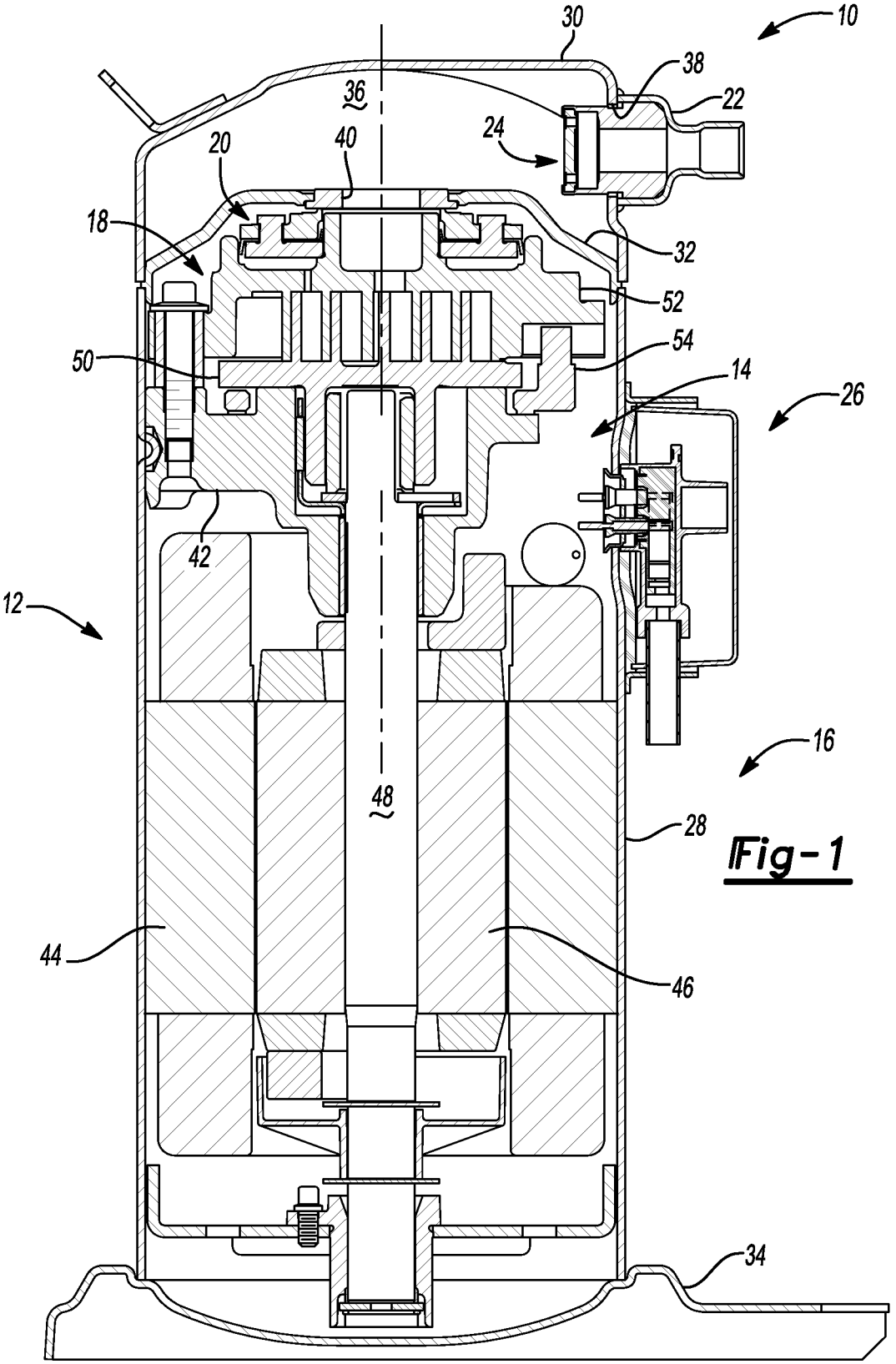
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, and a terminal assembly 26. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Partition 32 may include a discharge passage 40 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 42. Motor assembly 16 may generally include a motor stator 44, a rotor 46, and a drive shaft 48. Motor stator 44 may be press fit into shell 28. Drive shaft 48 may be rotatably driven by rotor 46 and may extend through main bearing housing 42.

Compression mechanism 18 may generally include an orbiting scroll 50 and a non-orbiting scroll 52. Orbiting scroll 50 may be supported on main bearing housing 42 and may be driven by drive shaft 48. An Oldham coupling 54 may be engaged with the orbiting and non-orbiting scrolls 50, 52 to prevent relative rotation therebetween. Non-orbiting scroll 52 may be rotationally secured to main bearing housing 42 and may be axially displaceable relative to main bearing housing 42 and orbiting scroll 50.

Seal assembly 20 may include a floating seal engaged with partition 32 and non-orbiting scroll 52. Seal assembly 20 may be axially displaceable relative to shell assembly 12 and non-orbiting scroll 52 and may provide for axial displacement of non-orbiting scroll 52 while maintaining a sealed engagement with partition 32 to isolate discharge and suction pressure regions of compressor 10 from one another.

Figure 2:
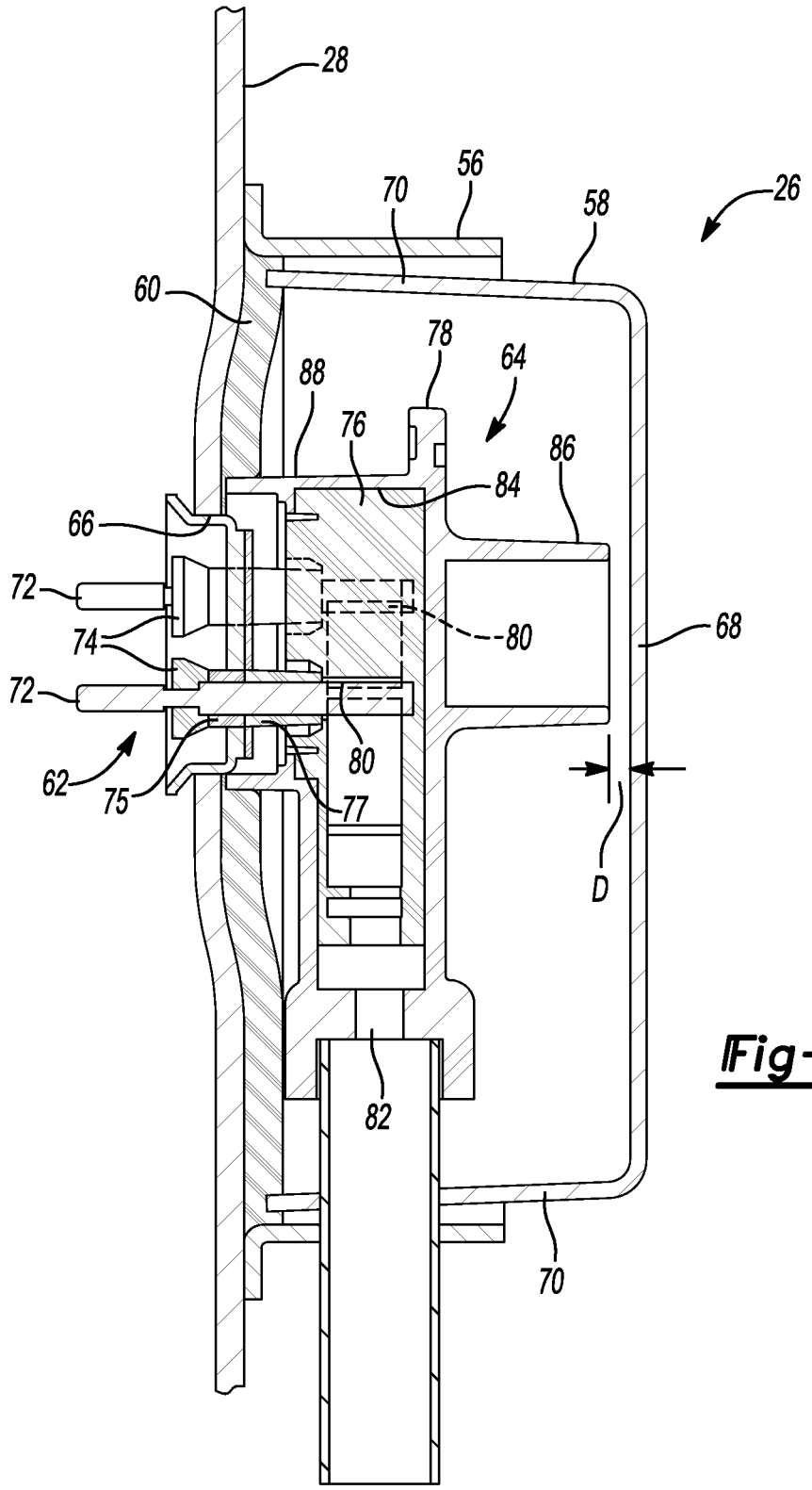
FIG. 2 is a fragmentary section view of the compressor of FIG. 1.
Figure 3:
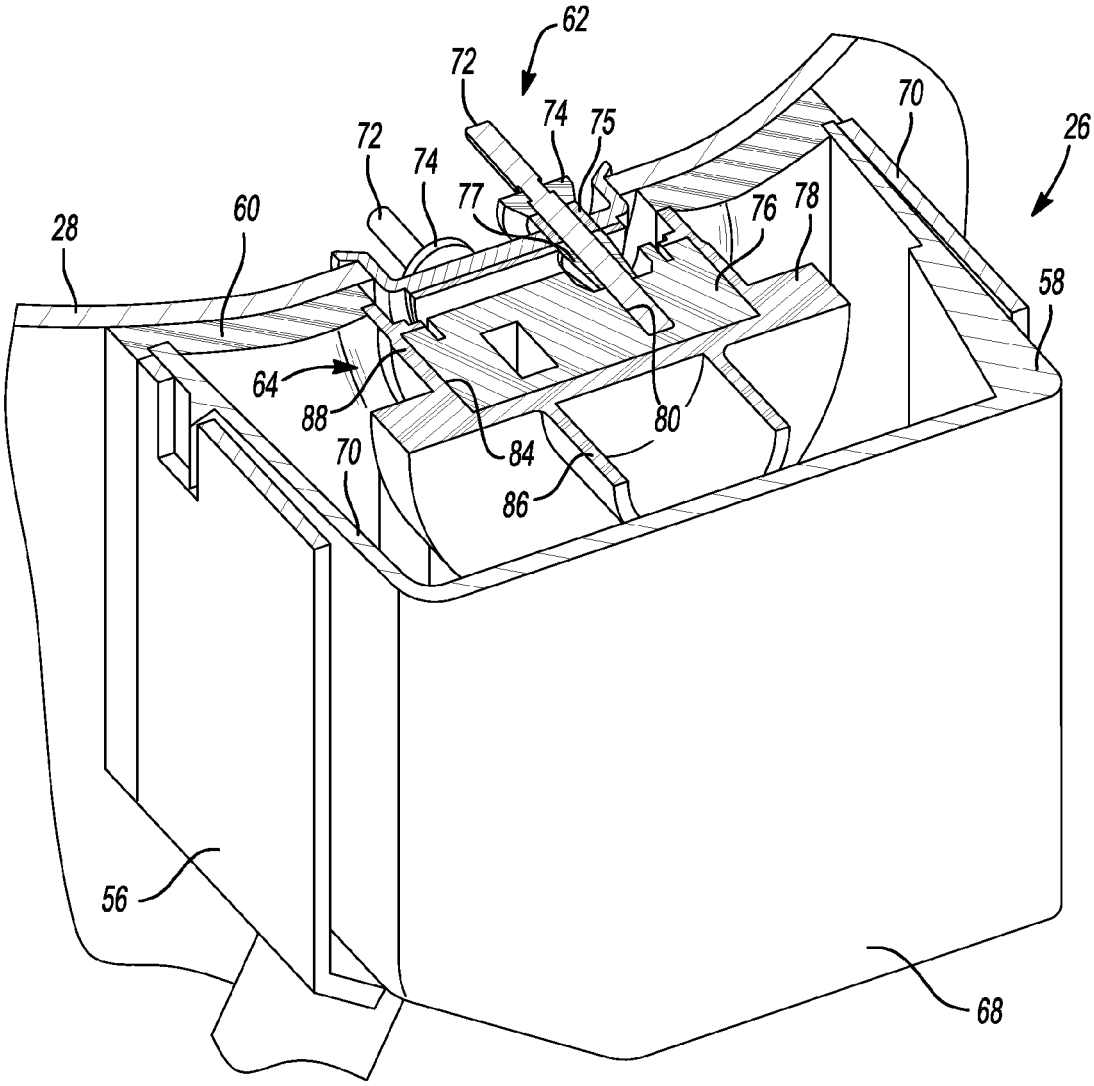
FIG. 3 is an additional fragmentary section view of the compressor of FIG. 1.

Terminal assembly 26 may be coupled to shell assembly 12 to provide electrical communication to compressor 10 from an external source. With reference to FIGS. 2 and 3, terminal assembly 26 may include a mounting bracket 56, a cover 58, a gasket 60, a terminal block 62, and a plug 64. Mounting bracket 56 may be fixed to shell assembly 12, surrounding an opening 66 housing terminal block 62. Cover 58 may be secured to bracket 56 in a variety of ways including a snap-fit engagement and may include a rear wall 68 having sidewalls 70 extending therefrom toward shell assembly 12. Gasket 60 may be formed from a compressible material such as a foam or an elastomer and may be located between cover 58 and shell assembly 12. More specifically, gasket 60 may be formed from neoprene. The engagement between mounting bracket 56 and cover 58 may compress gasket 60 between sidewalls 70 and shell assembly 12, forming a first sealing region.

Terminal block 62 may include pins 72 having ceramic insulators 74, fused glass insulators 75, and rubber boots 77 disposed thereon. Plug 64 may be engaged with pins 72. More specifically, plug 64 may include first and second portions 76, 78. First portion 76 may be housed within second portion 78 and may define receptacles 80 receiving pins 72 and providing electrical communication between pins 72 and a wire 82.

Second portion 78 may include a first recess 84 on a first side and a protrusion 86 a second side. The first side may face the terminal block 62 and the second side may face the cover 58. First recess 84 may define a wall 88 housing first portion 76. The engagement between pins 72 and receptacles 80 may maintain an engagement between first portion 76 and gasket 60, causing gasket 60 to be compressed against shell assembly 12 and forming a second sealing region. The engagement between pins 72 and receptacles 80 may additionally cause rubber boots 77 to abut first portion 76 forming a third sealing region.

Protrusion 86 may extend outward from shell assembly 12 generally toward rear wall 68 of cover 58. When pins 72 are fully installed within receptacles 80, protrusion 86 may be spaced from rear wall 68 a distance (D). However, the spacing (D) between protrusion 86 and rear wall 68 may limit a disengagement between pins 72 and receptacles 80. More specifically, the distance (D) may maintain at least a fifty percent engagement between pins 72 and receptacles 80. Plug 64 may compress gasket 60 a distance greater than the distance (D) when fully engaged with pins 72.

Figure 4:
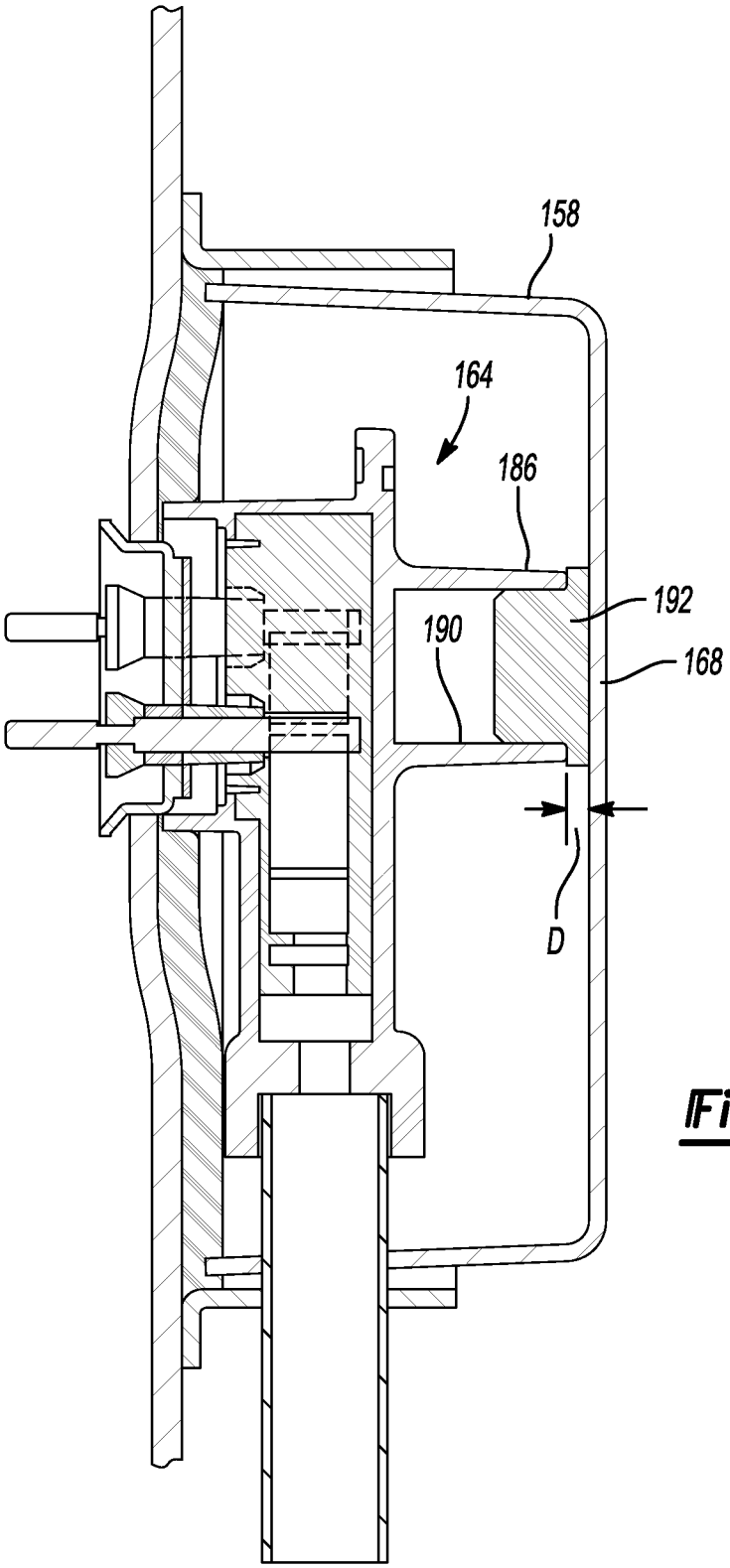
FIG. 4 is a fragmentary section view of an alternate compressor according to the present disclosure.

In an alternate example seen in FIG. 4, protrusion 186 may define a cavity 190 housing a resilient member 192, such as an elastomeric member. The member 192 may abut protrusion 186 and wall 168 of cover 158 to maintain engagement of plug 164 while limiting vibration transmission between cover 158 and plug 164.

Figure 5:
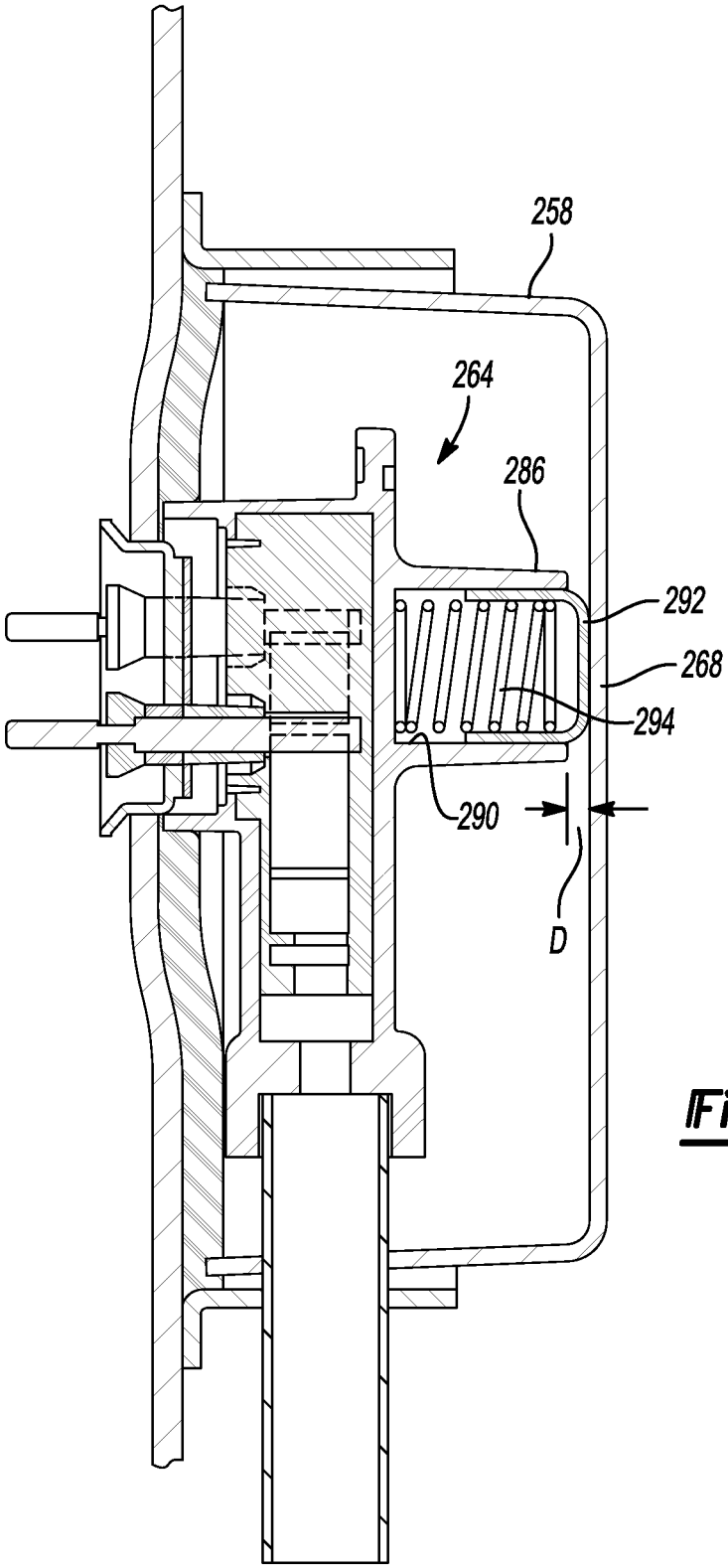
FIG. 5 is a fragmentary section view of an alternate compressor according to the present disclosure.

In an alternate example seen in FIG. 5, protrusion 286 may define a cavity 290 housing a piston member 292 and a biasing member 294. The member 292 may be forced into contact with wall 268 by biasing member 294. The engagement of biasing member 294 with plug 264 and piston member 292 may maintain engagement of plug 264 while limiting vibration transmission between cover 258 and plug 264.

What is claimed is:

1. A compressor comprising:

a shell;

a compression mechanism supported within said shell;

a motor drivingly engaged with said compression mechanism; and a terminal assembly including:

a cover secured relative to said shell;

a terminal block fixed to said shell and in electrical communication with said motor; and a plug engaged with said terminal block and providing electrical communication between said terminal block and a wire, said plug including a first side facing said terminal block and a second side opposite said first side and facing a wall of said cover, said second side including a protrusion extending in a direction axially away from said first side toward said wall and spaced a distance therefrom that is less than the axial extent of said protrusion.

2. The compressor of claim 1, wherein said protrusion is spaced the distance from said wall when said plug is fully engaged with pins of said terminal block, said spacing providing at least 50 percent engagement between said pins and said plug when said plug is displaced from full engagement with said pins to a position where said protrusion abuts said wall.

3. The compressor of claim 1, further comprising a seal surrounding said terminal block and located between said plug and said shell, said plug biasing said seal against said shell.

4. The compressor of claim 3, wherein said plug compresses said seal a distance greater than the distance between the protrusion and the wall.

5. The compressor of claim 3, wherein said cover is engaged with said seal and biases said seal against said shell at a location surrounding said plug.

6. The compressor of claim 1, wherein said terminal assembly further including a resilient member engaged with said protrusion and said wall of said cover to maintain engagement between said plug and said terminal block while limiting vibration transmission therebetween.

7. The compressor of claim 6, wherein said protrusion defines a cavity facing said cover and housing said resilient member therein.

8. The compressor of claim 7, wherein said resilient member includes an elastomeric member abutting said protrusion and said wall of said cover.

9. The compressor of claim 7, wherein said resilient member includes a piston and a biasing member located within said cavity and urging said piston against said wall of said cover.

10. The compressor of claim 1, further comprising a mounting bracket fixed to said shell and having said cover fixed thereto.

11. A compressor comprising:

a shell;

a compression mechanism supported within said shell;

a motor drivingly engaged with said compression mechanism; and a terminal assembly including:

a cover secured relative to said shell;

a terminal block fixed to said shell and in electrical communication with said motor; and a plug engaged with said terminal block and providing electrical communication between said terminal block and a wire, said plug including a first side facing said terminal block and a second side opposite said first side and facing a wall of said cover, said second side including a protrusion extending in a direction axially away from said first side toward said wall and spaced a distance therefrom that is less than the axial extent of said protrusion, said plug being displaceable from a first position where said plug is fully engaged with pins of said terminal block and free from engagement with said cover and a second position where said protrusion abuts said wall of said cover and said plug maintains at least 50 percent engagement with said pins.

12. The compressor of claim 11, further comprising a seal surrounding said terminal block and located between said plug and said shell, said plug biasing said seal against said shell.

13. The compressor of claim 12, wherein said plug is spaced a distance from said wall of said cover when fully engaged with said pins, said plug compressing said seal a distance greater than the distance between the protrusion and the wall.

14. The compressor of claim 12, wherein said cover is engaged with said seal and biases said seal against said shell at a location surrounding said plug.

15. A terminal assembly for a compressor having a motor contained within a shell and a terminal block fixed to the shell and in electrical communication with the motor, the terminal assembly comprising a cover adapted to be secured relative to the shell and a plug engaged with the terminal block and providing electrical communication between the terminal block and a wire, said plug including a first side facing the terminal block and a second side opposite said first side and facing a wall of said cover, said second side including a protrusion extending axially away from said first side and adapted to extend toward said wall and be spaced a distance therefrom that is less than the axial extent of said protrusion.

16. The terminal assembly of claim 15, wherein said protrusion is adapted to be spaced the distance from said wall when said plug is fully engaged with pins of said terminal block, said spacing providing at least 50 percent engagement between said pins and said plug when said plug is displaced from full engagement with said pins to a position where said protrusion abuts said wall.

17. The terminal assembly of claim 15, further comprising a resilient member engaged with said protrusion and said wall of said cover to maintain engagement between said plug and the terminal block while limiting vibration transmission therebetween.

18. The terminal assembly of claim 17, wherein said protrusion defines a cavity facing said cover and housing said resilient member therein.

19. The terminal assembly of claim 18, wherein said resilient member includes an elastomeric member abutting said protrusion and said wall of said cover.

20. The terminal assembly of claim 18, wherein said resilient member includes a piston and a biasing member located within said cavity and urging said piston against said wall of said cover.

21. The terminal assembly of claim 15, further comprising a seal surrounding said terminal block and located between said plug and said shell, said plug biasing said seal against said shell and compressing said seal a distance greater than the distance between the protrusion and the wall.

* * * * *